US006079747A

United States Patent [19]

Winsor

[11] Patent Number: 6,079,747

[45] Date of Patent: Jun. 27, 2000

[54] WALKING ATTACHMENT FOR IN-LINE SKATE

[76] Inventor: Bradley P. Winsor, 1865 Glenanna Rd., Apt. #107, Pickering, ON, Canada, L1V 3V5

[21] Appl. No.: 08/762,369

[22] Filed: Dec. 9, 1996

[51] Int. Cl.[7] ..... A63C 3/12

[52] U.S. Cl. ..... 280/825; 280/811

[58] Field of Search ..... 280/825, 11.22, 280/11.23, 811; 36/132

[56] References Cited

U.S. PATENT DOCUMENTS

| | | | |
|---|---|---|---|
| 3,861,697 | 1/1975 | Dolce | 280/11.1 R |
| 4,666,168 | 5/1987 | Hamill et al. | 280/11.2 |
| 5,522,621 | 6/1996 | Schneider | 280/11.22 |
| 5,573,275 | 11/1996 | Smith et al. | 280/825 |

FOREIGN PATENT DOCUMENTS

| | | | |
|---|---|---|---|
| 661924 | 4/1963 | Canada | 280/825 |

*Primary Examiner*—Lanna Mai
*Assistant Examiner*—David R. Dunn

[57] ABSTRACT

A new Cross Walkers for providing an attachment to existing roller blades which allows the user to walk safely without taking the roller blades off. The inventive device includes a front support member having a first slot and a second slot which each receive a wheel from the roller blades, a rear support member having a third slot and a fourth slot which each receive a wheel from the roller blades, and a securing means which adjustably secures the front and rear support members to the roller blade.

5 Claims, 3 Drawing Sheets

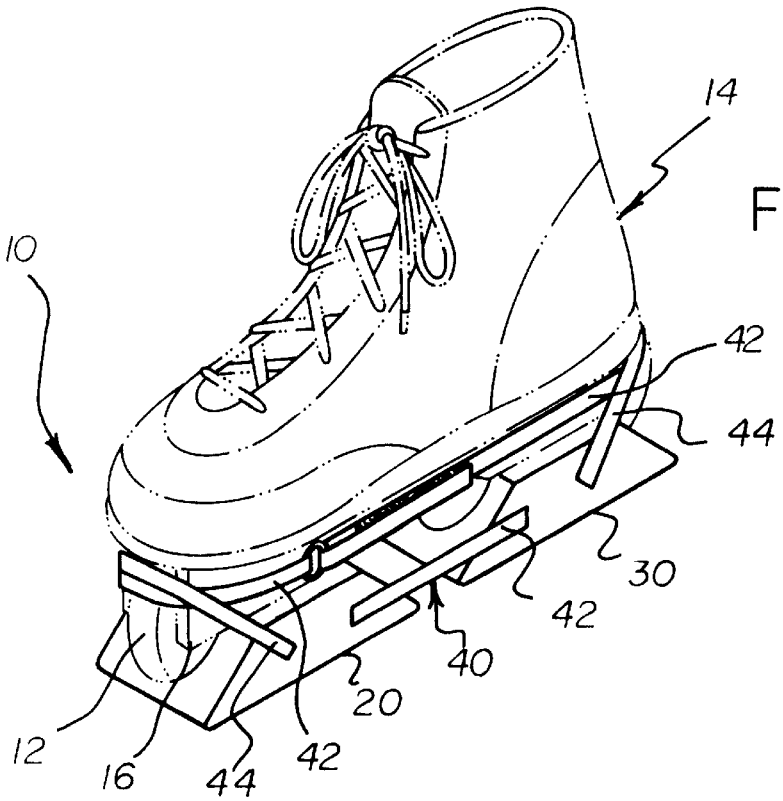
FIG. 1
FIG. 2
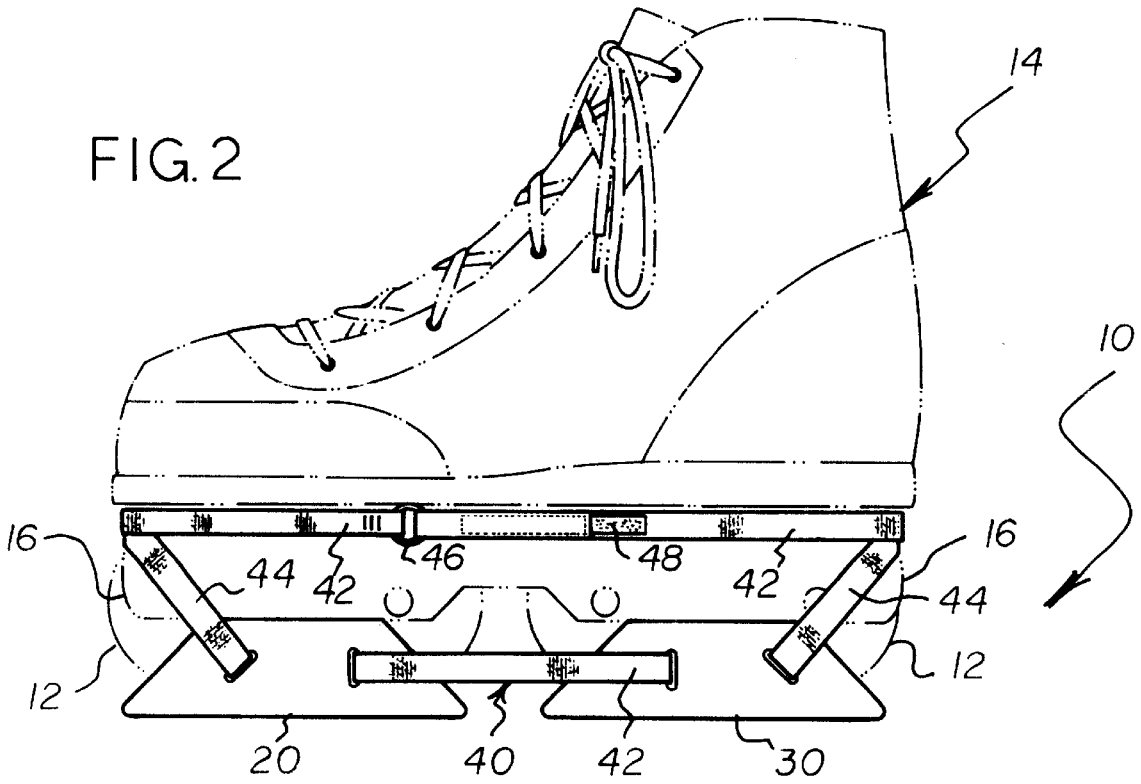

FIG. 3
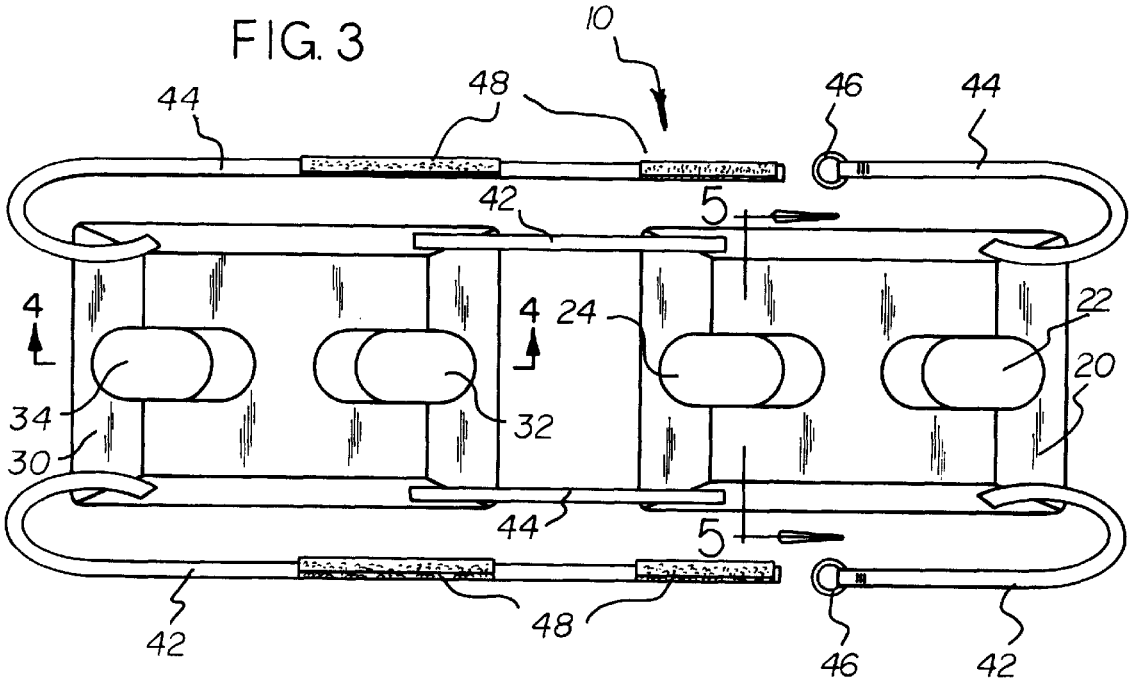
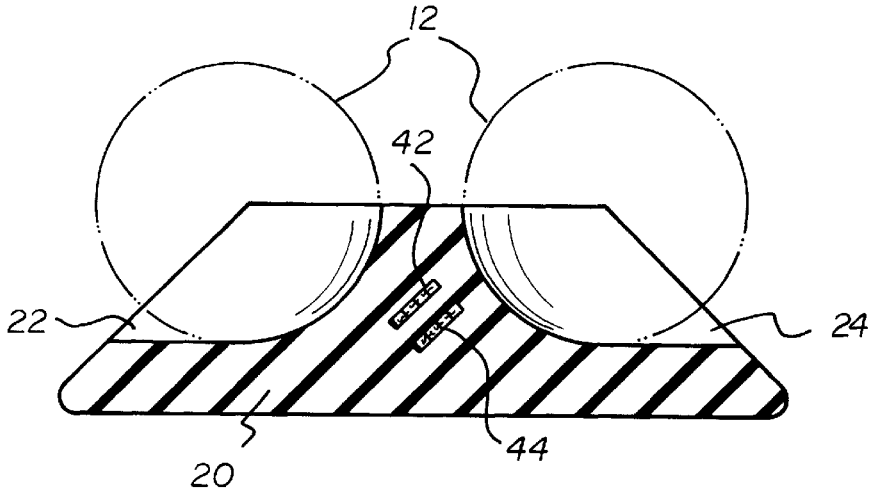
FIG. 4

WALKING ATTACHMENT FOR IN-LINE SKATE

BACKGROUND OF THE INVENTION

1. Field of the Invention

The present invention relates to Skate Guard Devices and more particularly pertains to a new Cross Walkers for providing an attachment to existing in-line skates which allows the user to walk safely without taking the in-line skates off.

2. Description of the Prior Art

The use of Skate Guard Devices is known in the prior art. More specifically, Skate Guard Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Skate Guard Devices include U.S. Pat. No. 5,303,955; U.S. Pat. No. 5,445,415; U.S. Pat. No. 5,290,065; U.S. Pat. No. 4,355,474; U.S. Pat. No. 5,236,224 and U.S. Pat. No. 4,413,842.

While these devices fulfill their respective, particular objectives and requirements, the aforementioned patents do not disclose a new Cross Walkers. The inventive device includes a front support member having a first slot and a second slot which each receive a wheel from the roller blades, a rear support member having a third slot and a fourth slot which each receive a wheel from the in-line skates, and a securing means which adjustably secures the front and rear support members to the in-line skates.

In these respects, the Cross Walkers according to the present invention substantially departs from the conventional concepts and designs of the prior art, and in so doing provides an apparatus primarily developed for the purpose of providing an attachment to existing in-line skates which allows the user to walk safely without taking the in-line skates off.

SUMMARY OF THE INVENTION

In view of the foregoing disadvantages inherent in the known types of Skate Guard Devices now present in the prior art, the present invention provides a new Cross Walkers construction wherein the same can be utilized for providing an attachment to existing in-line skates which allows the user to walk safely without taking the in-line skates off.

The general purpose of the present invention, which will be described subsequently in greater detail, is to provide a new Cross Walkers apparatus and method which has many of the advantages of the Skate Guard Devices mentioned heretofore and many novel features that result in a new Cross Walkers which is not anticipated, rendered obvious, suggested, or even implied by any of the prior art Skate Guard Devices, either alone or in any combination thereof.

To attain this, the present invention generally comprises a front support member having a first slot and a second slot which each receive a wheel from the in-line skates, a rear support member having a third slot and a fourth slot which each receive a wheel from the in-line skates, and a securing means which adjustably secures the front and rear support members to the in-line skates.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Cross Walkers apparatus and method which has many of the advantages of the Skate Guard Devices mentioned heretofore and many novel features that result in a new Cross Walkers which is not anticipated, rendered obvious, suggested, or even implied by any of the prior art Skate Guard Devices, either alone or in any combination thereof.

It is another object of the present invention to provide a new Cross Walkers which may be easily and efficiently manufactured and marketed.

It is a further object of the present invention to provide a new Cross Walkers which is of a durable and reliable construction.

An even further object of the present invention is to provide a new Cross Walkers which is susceptible of a low cost of manufacture with regard to both materials and labor, and which accordingly is then susceptible of low prices of sale to the consuming public, thereby making such Cross Walkers economically available to the buying public.

Still yet another object of the present invention is to provide a new Cross Walkers which provides in the apparatuses and methods of the prior art some of the advantages thereof, while simultaneously overcoming some of the disadvantages normally associated therewith.

Still another object of the present invention is to provide a new Cross Walkers for providing an attachment to existing in-line skates which allows the user to walk safely without taking the in-line skates off.

Yet another object of the present invention is to provide a new Cross Walkers which includes a front support member having a first slot and a second slot which each receive a wheel from the in-line skates, a rear support member having a third slot and a fourth slot which each receive a wheel from the in-line skates, and a securing means which adjustably secures the front and rear support members to the in-line skate.

Still yet another object of the present invention is to provide a new Cross Walkers that provides safety and convenience for a person in-line skating.

Even still another object of the present invention is to provide a new Cross Walkers that reduces the wear and tear on the wheels.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an upper side perspective view of a new Cross Walkers according to the present invention.

FIG. 2 is a side view of the present invention.

FIG. 3 is a top view of the present invention.

FIG. 4 is a cross sectional view taken along line 4—4 of FIG. 3.

DESCRIPTION OF THE PREFERRED EMBODIMENT

Figure 5:
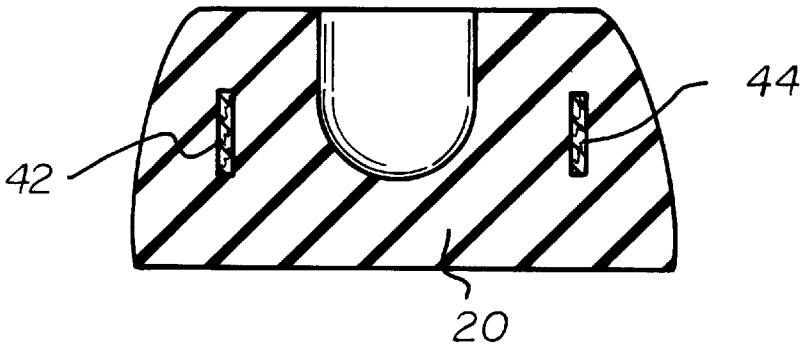
FIG. 5 is a cross sectional view taken along line 5—5 of FIG. 3.
Figure 6:
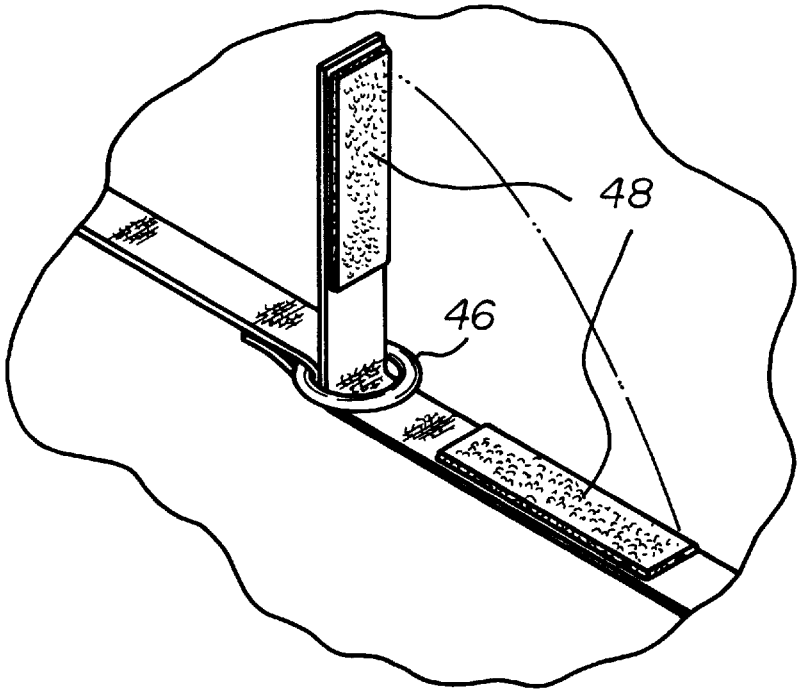
FIG. 6 is a magnified perspective view of the securing means.

With reference now to the drawings, and in particular to FIGS. 1 through 6 thereof, a new Cross Walkers embodying the principles and concepts of the present invention and generally designated by the reference numeral 10 will be described.

More specifically, it will be noted that the Cross Walkers 10 comprises a front support member 20, a rear support member 30 and a securing means 40. The Cross Walkers are preferably constructed from a resilient material such as a rubber or a foam material. As best shown in FIG. 4 of the drawings, the front support member 20 has a first slot 22 and a second slot 24. The first slot 22 extends from an end of the front support member 20 to near the concentric portion, or middle portion, and the second slot 24 extends from an end of the front support member 20 opposite of the first slot 22 to near the concentric portion. The first slot 22 and the second slot 24 are formed to receive a wheel 12 from an inline skate 14. A securing means 40 is adjustably secured to the front support member 20 and removably secured to the wheel support member 16 of the inline skate 14 as shown in FIGS. 1 and 2.

As shown in FIG. 3 of the drawings, a rear support member 30 has a third slot 32 and a fourth slot 34. The third slot 32 extends from an end of the rear support member 30 to near the concentric portion and the fourth slot 34 extends from an end of the rear support member 30 opposite of the third slot 32 to near the concentric portion. The third slot 32 and the fourth slot 34 are formed to receive a wheel 12 from an inline skate 14. The securing means 40 is adjustably secured to the rear support member 30 and removably secured to a wheel 12 support member of the inline skate 14. The securing means 40 has a first strap 42 slidably projecting through the left side of the front support member 20 and slidably exiting out the right side of the front support member 20. The first strap thereafter slidably projects through the right side of the rear support member 30 and slidably exits out the left side of the rear support member 30 as shown in FIGS. 1 through 3. A second strap 44 slidably projects through the right side of the front support member 20 and slidably exits out the left side of the front support member 20. The second strap 44 thereafter slidably projects through the left side of the rear support member 30 and slidably exits out the right side of the rear support member 30. A loop 46 is secured to an end of the first strap 42 and another loop 46 is secured to an end of the second strap 44 as best shown in FIG. 3 of the drawings. As shown in FIG. 3, a hook and loop fastener or pile fastener such as VELCRO 48 is secured to an end of the first strap 42 opposite of the loop 46. Another VELCRO 48 is secured to an end of the second strap 44 opposite of the loop 46. The first strap 42 and second strap 44 project through respective loops 46 and the VELCRO 48 retains the first strap 42 and the second strap 44 secured to the respective loops 46. The front support member 20 and the rear support member 30 preferably are constructed from a resilient material. The front support member 20 and the rear support member 30 may be constructed from rubber or a foam material.

In use, the user positions the wheels 12 of the inline skate 14 into the first, second, third and fourth slots 22, 24, 32, 34 of the front and rear support members 20, 30. The securing means is thereafter adjustably secured to retain the front and rear support members 20, 30 to the wheels 12 of the inline skate 14. The user thereafter is able to walk with the front and rear support members 20, 30 engaging the ground instead of the wheels 12. This allows the user to access areas previously unable to access without taking off the inline skates 14. When the user desires to skate again, the user simply loosens the securing means 40 and removes the front and second support members 20, 30 thereby allowing the wheels 12 to engage the ground.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A system comprising:

an in-line skate;

a front support member having a first slot and a second slot, where said first slot extends from an end of said front support member to near a middle portion and said second slot extends from an end of said front support member opposite of said first slot to near the middle portion;

said first slot and said second slot are formed to each receive a wheel from said inline skate;

a securing means adjustably secured to said front support member and removably secured to a wheel support member of said inline skate; and a rear support member including a third slot and a fourth slot, where said third slot extends from an end of said rear support member to near a middle portion of the rear support member and said fourth slot extends from an end of said rear support member opposite of said third slot to near the middle portion of the rear support member;

said third slot and said fourth slot are formed to each receive a wheel from an inline skate;

said securing means adjustably secured to said rear support member and removably secured to said wheel support member of said inline skate;

wherein said securing means comprises a first strap slidably projecting through the left side of said front support member and slidably exiting out the right side of said front support member then slidably projecting through the right side of said rear support member and slidably exiting out the left side of said rear support member; a second strap slidably projecting through the right side of said front support member and slidably exiting out the left side of said front support member then slidably projecting through the left side of said rear support member and slidably exiting out the right side of said rear support member; a loop secured to an end of said first strap and another loop secured to an end of said second strap; and pile fasteners secured to an end of said first strap opposite of said loop and another pile fasteners secured to an end of said second strap opposite of said loop, where said first strap and second strap project through respective said loops and said pile fasteners retains said first strap and said second strap secured to said respective loops.

2. The system of claim 1, wherein said front support member and said rear support member comprise a resilient material.

3. The system of claim 2, wherein said front support member and said rear support member comprise rubber.

4. The system of claim 2, wherein said front support member and said rear support member comprise a foam material.

5. A system for attachment to an inline skate having a plurality of wheels secured to a wheel support member, said system comprising:

a front support member having a first slot and a second slot, wherein said first slot extends from an end of said front support member to near a middle portion and said second slot extends from an end of said front support member opposite of said first slot to near the middle portion;

said first slot and said second slot being formed to each receive a wheel of said inline skate;

a securing means adjustable secured to said front support member for removably securing to the wheel support member of said inline skate; and a rear support member including a third slot and a fourth slot, wherein said third slot extends from an end of said rear support member to near a middle portion of the rear support member and said fourth slot extends from an end of said rear support member opposite of said third slot to near the middle portion of the rear support member;

said third slot and said fourth slot being formed to each receive a wheel of said inline skate;

said securing means adjustable secured to said rear support member for removably securing to said wheel support member of said inline skate;

wherein said securing means comprises a first strap slidably projecting through the left side of said front support member and slidably exiting out the right side of said front support member then slidably projecting through the right side of said rear support member and slidably exiting out the left side of said rear support member; a second strap slidably projecting through the right side of said front support member and slidably exiting out the left side of said front support member then slidably projecting through the left side of said rear support member and slidably exiting out the right side of said rear support member; a loop secured to an end of said first strap and another loop secured to an end of said second strap; and pile fasteners secured to an end of said first strap opposite of said loop and another pile fasteners secured to an end of said second strap opposite of said loop, where said first strap and second strap project through respective said loops and said pile fasteners retains said first strap and said second strap secured to said respective loops.

* * * * *